United States Patent [19]

Strzodka

[11] Patent Number: 4,827,093

[45] Date of Patent: May 2, 1989

[54] ADJUSTABLE PRESSURE-TYPE SWITCH

[75] Inventor: Hubert F. Strzodka, Friedberg, Fed. Rep. of Germany

[73] Assignee: Delaval Turbine GmbH, Reichelsheim, Fed. Rep. of Germany

[21] Appl. No.: 176,270

[22] Filed: Mar. 31, 1988

[30] Foreign Application Priority Data

Mar. 31, 1987 [DE] Fed. Rep. of Germany ..... 3710645

[51] Int. Cl.[4] ..... H01H 35/38

[52] U.S. Cl. ..... 200/82 C; 200/294; 200/339

[58] Field of Search ..... 73/745; 340/611, 626; 91/1; 92/5 R; 307/118; 200/81.4, 81 R, 83 S, 83 SA, 82 R, 82 C, 293, 294, 330, 331, 335, 339, 308, 83 J

[56] References Cited

U.S. PATENT DOCUMENTS 3,449,535 6/1969 Otto ..... 200/82 C
3,937,912 2/1976 Martin ..... 200/82 C

FOREIGN PATENT DOCUMENTS 1640360 1/1972 Fed. Rep. of Germany .
7913018 9/1979 Fed. Rep. of Germany .
3202512 8/1983 Fed. Rep. of Germany .
216131 11/1984 Fed. Rep. of Germany .
882291 5/1943 France .
1413574 11/1975 United Kingdom ..... 200/82 C

*Primary Examiner*—Gerald P. Tolin
*Attorney, Agent, or Firm*—Wegner & Bretschneider

[57] ABSTRACT

A pressure switch has a plunger, axially displaceable by the pressure being measured, which enables a contact pin of a microswitch to be actuated. Between the plunger and the contact pin there is arranged a rocker. The microswitch is fastened to the housing of the pressure switch so as to be displaceable in the main extension direction of the rocker. This provides a way to vary the step-up ratio between the plunger motion and the contact-pin motion, whereby the magnitude of the hysteresis of the pressure switch can be varied.

10 Claims, 1 Drawing Sheet

ADJUSTABLE PRESSURE-TYPE SWITCH

Figure 1:
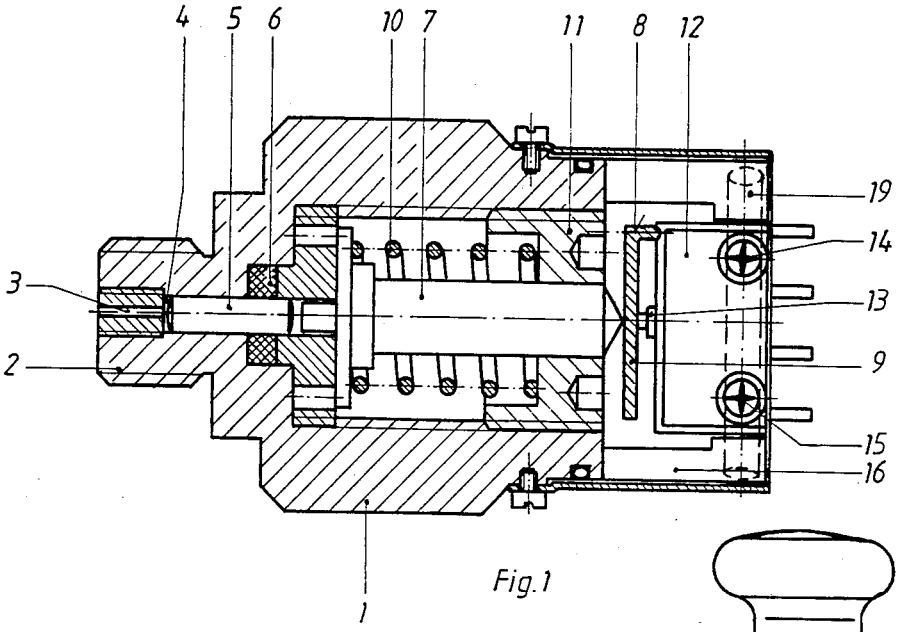

The invention relates to a pressure switch with a pressure chamber, the switch being acted upon by the pressure medium to be measured, and a plunger actuating a contact pin of a microswitch. Such pressure switches are generally known and in common use.

For design-related reasons, the switching point of pressure switches of this type is higher during a pressure rise than during a pressure reduction, since after reaching the switching point during a pressure rise and subsequent pressure reduction the contact pin must first traverse a different path before the so-called switch-back point is reached. One can make use of this hysteresis in, for example, a pressure control mechanism having such a pressure switch. If, for example, a pressure of between 130 and 160 bar is to be maintained in a tank, then one can choose a pressure switch whose microswitch switches off the pump producing the pressure at 160 bar as the pressure is rising and switches it back on at 130 bar as the pressure is falling, so that the pump begins to operate again.

If one requires a high degree of accuracy in the switching points for rising and filling pressure with microswitches, then microswitches having the desired exact switching points have to be selected from a large number of finished microswitches. In addition, after the pressure switch is assembled, the microswitches required for a specified hysteresis of the pressure switch have to be picked out on the test stand. Accordingly, pressure switches having specified switch-on and switch-off points are substantially more expensive than pressure switches have only a single specified switching point.

The selection of suitable microswitches for the pressure switch also cannot be avoided by shifting the range of the switching points upward or downward by changing the spring force of their setting spring which prestresses their plunger in the switching direction, because this setting capabiltiy does not suffice for many applications, since the range between the switch-on point and the switch-back point is often larger or smaller than required owing to tolerances.

The underlying problem of the invention is to create a pressure switch of the above-mentioned type such that not only is the range between the switch-on point and the switch-back point shifted as a whole, but also the mutual separation of these points is variable.

This problem is solved according to the present invention through the use of a rocker located between the contact pin and the plunger so that the plunger presses on the rocker from one side and the contact pin presses from the opposite side; the microswitch with its contact pin being arranged so as to be displaceable transversely with respect to the plunger in the lengthwise extension direction of the rocker. In other words, the pressure switch of the present invention has:

a plunger acted upon by the pressure medium to be measured;

a microswitch having a contact pin, said microswitch being displaceable in a direction perpendicular to the longitudinal axis of said plunger; the movement of said plunger actuating said contact pin; and a rocker disposed between said plunger and said contact pin, so that displacement of said microswitch varies the step-up ratio between the displacement of said plunger and the displacement of said contact pin.

Through the insertion of the rocker between the plunger of the pressure switch and the contact pin of the microswitch, the pressure-dependent axial displacement of the contact pin is stepped up in accordance with the lever ratio of the rocker. The step-up ratio can be varied by means of the displaceability of the microswitch. It thereby becomes possible to vary the separation between the switch-on point of the microswitch and the switch-back point, so that the difference path between the contact pin positions during switching can not only be shifted by means of the setting spring but can also be made smaller or larger. One can thereby use microswitches with coarse tolerances for the pressure switch according to the invention and adjust the exact switching points in each instance.

In order that the displacement of the microswitch does not necessarily result in an axial displacement of the plunger and the contact pin, the rocker must be aligned transversely with respect to the plunger in the displacement direction of the microswitch.

An especially large variation of the step-up ratio between the displacement of the plunger and of the contact pin can be achieved if the rocker is hinged on one side of the microswitch housing lying in the displacement direction of the rocker. This arrangement permits a large variation in the step-up ratio due to the fact that, by displacing the microswitch, the swivel axis of the rocker can be shifted to just above the plunger, so that slight displacements of the plunger lead to a large swiveling of the rocker.

The axial displacement of the plunger can be optionally stepped up or stepped down if the microswitch is constructed so as to be displaceable in two opposite directions from a position in which its contact pin is aligned with the plunger.

The displaceability of the microswitch can be achieved in very different ways. In one preferred embodiment, especially sensitive displacement of the microswitch is possible by installing the microswitch with its back pressing against a wall surface connecting the microswitch, by means of at least one fastening screw leading through an elongated slot in the wall surface, to a slide arranged in a hole running in the displacement direction behind the wall surface and if, furthermore, means are provided for sensitive displacement of the slide when the fastening screw is loosened.

The means for adjusting the slide can also have very different constructions. For example, the slide can be formed as a toothed rack and a pinion gear can be provided for engaging the toothed rack in order to displace the slide. The slide can be displaced especially simply if, in accordance with another preferred embodiment of the invention, the slide engages with a part of its lateral surface in a hole, running transversely with respect to the displacement direction, for the insertion of an adjusting tool.

The teeth on the slide can be eliminated if the slide is made of a material which is soft in comparison with that of the adjusting tool, and the adjusting tool is a screw having multiple threads at one end thereof.

Figure 2:
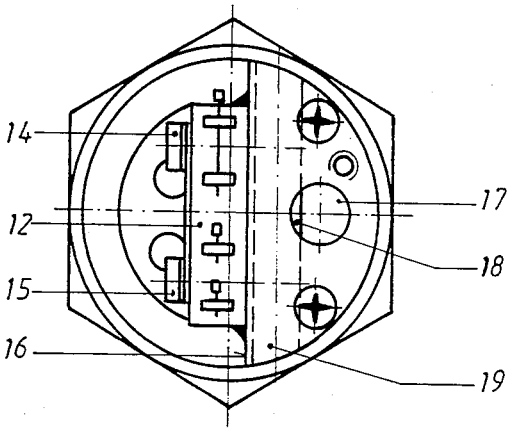
Figure 3:
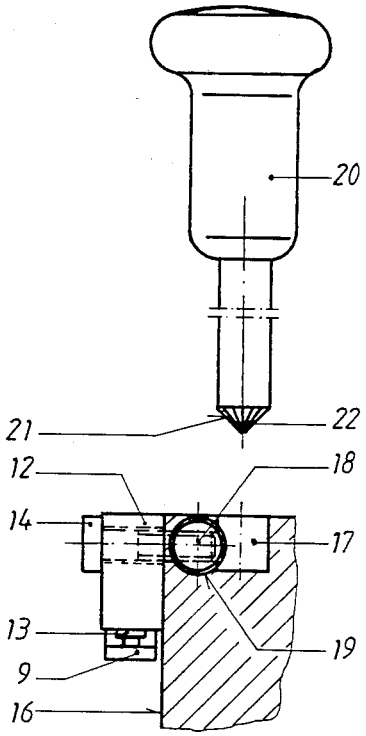

The invention allows numerous embodiments. One of them is illustrated in the drawing and is described below. In it, FIG. 1 shows a longitudinal section through a pressure switch according to the invention, FIG. 2 shows a front view of the pressure switch, FIG. 3 shows an enlarged sectional illustration through the pressure switch in the region of the fastening of its microswitch.

As can be seen in FIG. 1, the pressure switch according to the invention has a housing 1 with a threaded connection piece 2 for screwing into a nonillustrated threaded hole in the component to which it is to be fitted. In the threaded connection piece 2 there is provided a coaxial hole 3 through which the pressure medium to be measured can pass into a pressure chamber 4 until it is in front of the end face of a piston 5. This piston 5 is sealed off from the housing 1 by means of a seal 6, so that the application of pressure to the pressure chamber 4 leads to a displacement of the piston 5 to the right as seen in the drawing. The piston 5 is thereby pressed against a plunger 7 whose opposite end presses against a rocker 9 which is swivelable about an axle 8 and is spaced transversely from the plunger 7 and aligned substantially parallel thereto.

A setting spring 10 pre-stresses the plunger in the direction of the piston 5, for which purpose it is braced against a screw piece 11 which can be screwed more or less far into the housing 1 in order to vary the tension force of the setting spring 10.

The rocker 9 is fastened with its axle 8 to the housing of a microswitch 12. This microswitch 12 has a contact pin 13 which presses against the rocker 9 on the side facing toward the microswitch 12 and which is aligned with the plunger in the illustrated position. It is essential for the invention that the microswitch 12 is fastened to the housing 1 so as to be transversely displaceable with respect to the plunger 7. For this purpose it is held by means of two fastening screws 14, 15 against a wall surface 16, in a manner set forth in detail below. If one loosens these fastening screws 14, 15 and pushes the microswitch 12 downward as seen in the drawing, then the plunger 7 presses against the rocker 9 closer to the axle 8 than in the illustrated middle position. A slight axial displacement of the plunger 7 thereby results in a relatively larger swiveling motion of the rocker 9 and thus in a correspondingly large displacement of the contact pin 13, so that switching occurs earlier.

If one displaces the microswitch 12 upward as seen in the drawing, then a path stepdown occurs. In this case, the plunger 7 must be displaced relatively far axially in order to cause a slight displacement of the contact pin 13.

FIG. 2 illustrates the construction of the pressure switch. The microswitch 12 presses against the wall surface 16 and is held by fastening screws 14, 15. A hole 17 is formed in the end face of the microswitch, through which a portion of the lateral surface of a cylindrical slide 18 is exposed.

FIG. 3 shows that this slide 18 is movably disposed in a hole 19 and that the fastening screws 14, 15 are screwed through the microswitch 12 into this slide 18. A nonillustrated slot in the wall surface 16 permits displacement of the microswitch 12 together with the slide 18, once the fastening screws 14, 15 are loosened.

An adjustment tool 20 may be used for sensitive displacement of the slide 18, the adjustment tool 20 having, at its lower end, a cone 21 with multiple teeth 22. The adjustment tool 20 is inserted into the hole 17 so that its multiple teeth 22 sit on the lateral surface of the slide 18. Since the slide 18 is made of a softer material than that of the teeth 22, the latter presses into the lateral surface of the slide 18, so that by turning the adjustment tool 20 the slide can be displaced as if it had rack-like toothing. In practice, one displaces the slide 18, and the microswitch 12 therewith, so far and in such a direction that the difference path of the pressure switch has the required magnitude.

LIST OF UTILIZED REFERENCE SYMBOLS

1 Housing
2 Threaded connection piece
3 Hole
4 Pressure chamber
5 Piston
6 Seal
7 Plunger
8 Axle
9 Rocker
10 Setting spring
11 Screw piece
12 Microswitch
13 Contact pin
14 Fastening screw
15 Fastening screw
16 Wall surface
17 Hole
18 Slide
19 Hole
20 Adjustment tool
21 Cone
22 Multiple teeth

I claim:

1. A pressure switch comprising:

a plunger acted upon by the pressure medium to be measured;

a microswitch having a contact pin, said microswitch being displaceable only in a direction perpendicular to the longitudinal axis of said plunger; the movement of said plunger actuating said contact pin by moving the contact pin in the same direction as the movement of the plunger; and a rocker disposed between said plunger and said contact pin, so that displacement of said microswitch varies the step-up ratio between the displacement of said plunger and the displacement of said contact pin.

2. Pressure switch according to claim 1, wherein the rocker is aligned transversely with respect to the plunger in the displacement direction of the microswitch.

3. Pressure switch according to claim 2, characterized in that the rocker is hinged on a side of the microswitch housing lying in the displacement direction of the rocker.

4. Pressure switch according to claim 1, wherein the microswitch is constructed so as to be displaceable in two opposite directions from a position in which its contact pin is aligned with the plunger.

5. Pressure switch according to claim 1, wherein the microswitch has its back pressing against a wall surface and is connected, by means of at least one fastening screw leading through an elongated hole in the wall surface, to a slide arranged in a hole running in the displacement direction behind the wall surface and that, furthermore, means are provided for sensitive displacement of the slide when the fastening screw is loosened.

6. Pressure switch according to claim 4, wherein the slide engages with a part of its lateral surface into a hole, running transversely with respect to the displacement direction, for the insertion of an adjusting tool.

7. Pressure switch according to claim 6, wherein the slide is made of a soft material in comparison to that of the adjusting tool, and the adjusting tool has multiple toothing at one end thereof.

8. Pressure switch according to claim 1, wherein the rocker is hinged on a side of the microswitch housing lying in the displacement direction of the rocker.

9. A pressure switch comprising:

a plunger acted upon by the pressure medium to be measured;

a microswitch having a contact pin, said microswitch being displaceable in a direction perpendicular to the longitudinal axis of said plunger; the movement of said plunger actuating said contact pin;

a rocker disposed between said plunger and said contact pin, so that displacement of said microswitch varies the step-up ratio between the displacement of said plunger and the displacement of said contact pin;

said microswitch having its back pressing against a wall surface and being connected, by means of at least one fastening screw leading through an elongated hole in the wall surface, to a slide arranged in a hole running in the displacement direction behind the wall surface; and means for sensitive displacement of the slide when the fastening screw is loosened, said means for sensitive displacement including said slide engaging with a part of its lateral surface into a hole, running transversely with respect to the displacement direction, for the insertion of an adjusting tool.

10. Pressure switch according to claim 9, wherein the slide is made of a soft material in comparison to that of the adjusting tool, and the adjusting tool has multiple toothing at one end thereof which engages the slide.

* * * * *